US006837409B2

(12) United States Patent
Lemanski, II

(10) Patent No.: US 6,837,409 B2
(45) Date of Patent: Jan. 4, 2005

(54) BACKPACK SYSTEM

(76) Inventor: Gerald Lemanski, II, 1300-A E. 8th St., Tempe, AZ (US) 85281

( * ) Notice: Subject to any disclaimer, the term of this patent is extended or adjusted under 35 U.S.C. 154(b) by 181 days.

(21) Appl. No.: 10/329,126

(22) Filed: Dec. 24, 2002

(65) Prior Publication Data

US 2003/0121945 A1 Jul. 3, 2003

Related U.S. Application Data

(60) Provisional application No. 60/344,575, filed on Dec. 28, 2001.

(51) Int. Cl.[7] ..... A47F 3/04

(52) U.S. Cl. ..... 224/579; 224/578; 224/631; 224/637; 224/641

(58) Field of Search ..... 224/578, 579, 224/607, 616, 617, 625, 626, 631, 637, 641

(56) References Cited

U.S. PATENT DOCUMENTS 4,318,502 A * 3/1982 Lowe et al. ..... 224/637
4,836,426 A * 6/1989 Munn et al. ..... 224/625
5,228,609 A * 7/1993 Gregory ..... 224/617
5,564,612 A * 10/1996 Gregory ..... 224/637
5,762,251 A * 6/1998 Gleason ..... 224/641
5,975,387 A * 11/1999 Gleason et al. ..... 224/641
5,984,157 A * 11/1999 Swetish ..... 224/631
6,024,265 A * 2/2000 Clements ..... 224/631
6,164,509 A * 12/2000 Gausling et al. ..... 224/631
6,290,114 B1 * 9/2001 Berberian ..... 224/637

* cited by examiner

*Primary Examiner*—Gary E. Elkins
(74) *Attorney, Agent, or Firm*—Gregory J. Nelson

(57) ABSTRACT

A pack system having a suspension system with a waist belt which slidably carries a bag or pack. At least one shoulder strap extends between the top of the bag and the side of the bag. A compression suspension system attaches to the pack at multiple locations and is adjustable to stabilize the pack in a comfortable position to accommodate varying loads. The system allows the pack to be shifted or rotated around the body of the wearer between frontal access or rear carrying position for comfort and accessibility.

16 Claims, 8 Drawing Sheets

BACKPACK SYSTEM

CROSS REFERENCE TO RELATED APPLICATION

This application is based on provisional patent application Ser. No. 60/344,575, filed Dec. 28, 2001, entitled "Backpack System."

FIELD OF THE INVENTION

The present invention relates to an article carrier and more particularly relates to an adjustable backpack suspension system which allows the pack to be easily shifted from the load carrying position at the back of the wearer to an access position at the side or front of the wearer and which system stabilizes and compresses the load in the carrying position.

BACKGROUND OF THE INVENTION

Backpacks are widely used and accepted for carrying loads from student's books to military equipment and supplies. Backpacks have evolved over the years from a simple bag with a strap to more sophisticated systems for better weight distribution. Since children and students commonly use backpacks for carrying books and school supplies, the American Chiropractic Association has set forth certain guidelines and recommendations as the improper use and wearing backpacks can lead to muscle imbalance that can result in chronic back and neck problems. As a general recommendation, the backpack and load should weigh no more than 5 to 10 percent of the wearer's body weight and the backpack should have shoulder straps that are adjustable so the backpack can be fitted to the wearer's body. In an attempt to improve both the comfort and the convenience of backpacks, various pack designs can be found in the prior art patent literature.

For example U.S. Pat. No. 5,465,886 discloses a pack which includes a bag and a belt attached to the bag. The belt has a first flexible belt portion extending from the bag at one side of the torso and terminating at a free end. A second flexible belt portion extends from the bag at the other side of the torso terminating at a free end. A connecting device on each belt portion connects the belt portions. The connecting device on the first belt portion is movable longitudinally. When the connecting devices are engaged, the free end of the first belt is adapted to be inserted through the loop and pulled against the loop to cinch the belt tightly around the wearer's torso.

U.S. Pat. No. 5,228,609 discloses an improved fanny-pack which includes a back-support section to which a carry bag is attached, including a semi-rigid plate of polyethylene. Attached to the back-support section are a pair of waistband members. Additional straps attached at the bottom and top of the carry bag pass through loop members anchored outboard of the belt and may be pulled and secured to the carry bag.

A backpack carrier assembly is shown in U.S. Pat. No. 4,982,884. In this patent, a pivotal coupling is provided with the back portion at or above the center of gravity of the backpack so the backpack is free to swing from side to side behind the hips of the wearer. Low friction blocks, pads, rollers or surfaces are provided in order to reduce frictional forces.

U.S. Pat. No. 4,878,606 discloses a harness for a shoulder-supported bag. The harness restrains movement of the bag while in use and inhibits posture deformation of the wearer. The harness partially redistributes the load. A pelvic belt enhances the stability by retaining the bag in a substantially constant position. A shoulder pad and strap are restrained by an underarm strap to reduce stress.

U.S. Pat. No. 5,806,741 discloses a load-carrying system comprising a pack frame and waist-encircling belt. The belt includes a receptacle attached to the exterior side of the belt located midway between its ends. The receptacle has an opening to receive the male formation. The load-carrying system further includes at least one interfering member attached to the receptacle and positioned within the receptacle opening. The interfering member is adapted for engaging the engagement portion of the male formation. The interfering member prevents the male formation from becoming dislodged from the receptacle when the pack frame is in a generally vertical orientation and allows the male formation to become to dislodged when orientation of the pack frame is less than vertical.

U.S. Pat. No. 5,361,955 discloses a modular backpack for carrying heavy loads. The backpack includes a back panel with a polyfoam layer, a stretch fabric cover and a fabric layer between the polyfoam layer and the back panel, all molded to define a number of smaller polyfoam pads. The carry bag is attached to the back panel in a separate waist support having separate mobile left and right waistbands is fastened thereto. A pair of generally triangular stress panels are stitched to the lower part of the back panel on each side so as to overlay the outside of the waistband pads and the pads of the shoulder straps.

Thus, from the foregoing, it will be seen that there are numerous designs for backpacks and fanny-packs which attempt to stabilize the load, increase comfort and increase the convenience to the wearer. However, one significant disadvantage to backpacks of the type described above is that it is generally necessary for the backpack to be entirely removed from the back of the wearer before the backpack wearer can access the contents of the backpack. The wearer must disengage the backpack, then open the pack to access the contents and thereafter replace the backpack in a position on the wearer's back. This procedure requires considerable time and is inconvenient, particularly if the wearer is engaged in a strenuous activity such as hiking, rock climbing, rescue operations, running or adventure racing.

Accordingly, it is highly desirable to have a backpack which, when worn, can be shifted from a normal position on the back of the wearer to a position in which the wearer can gain access to the contents without the necessity of having to remove the backpack.

My prior patent, U.S. Pat. No. 5,437,403 discloses an improved travel pack or backpack which can be readily accessed by the wearer when the pack is positioned at the front of the wearer which can be moved or shifted between the front and back of the wearer without requiring the pack to be removed and then donned again when the backpack is in the use position. The pack may be worn and shifted beneath an outer coat or garment and may also be shifted even when the wearer is in a prone position. However, while it is believed that the system of this patent provides substantial functional benefits in permitting shifting of the pack, there nevertheless exists a need for further improvements which enhance the versatility, ease of use and convenience of a dynamic pack system which can be shifted without the wearer having to interrupt his or her activity to access or shift the pack.

BRIEF SUMMARY OF THE INVENTION

Briefly, the present invention provides a pack system which, in the normal use position, is carried or supported on the back of the wearer. The term "pack" or "backpack," as used herein, comprehends a bag, receptacle, frame or pack of any shape. The pack system may be made of any material consistent with the intended use. Generally the pack includes various pouches or pockets for receipt and containment of stored items and may be specifically designed for items such as cameras, electronic equipment, computer equipment or military equipment. The pack system includes a waist belt at the lower edge of the pack which extends around and circumscribes the body of the wearer along the top of the wearer's pelvic area. The opposite ends of the belt are securable at an adjustable connector such as a bayonet style, side squeeze buckle. The waist belt may be permanently attached to the pack, but preferably is slidably received to the pack at one or more belt loops or attachment locations near the bottom or middle of the pack on the front surface adjacent the back of the wearer.

The opposite side edges of the pack are tethered to the sides of the belt by a compression-suspension system which attaches to the pack by a strap at multiple spaced-apart locations and which system is adjustable to laterally compress and stabilize the pack and its contents in a comfortable position. The system will accommodate a wide range of loads of various shapes and densities.

The pack system is an articulated, self-adjusting system that permits the pack to be rotated around the wearer's body between a front access position and a rear carrying position. The system allows the pack to be locked into place or released. The waist belt remains connected to the pack when the belt is released providing slack allowing the wearer to slide the pack around the wearer's body and beneath one arm to a frontal or rear position. As the pack slides around the wearer's body, the pack will tend to rotate with the waist belt to facilitate the sliding action. The pack may also tilt or pivot slightly to accommodate passage beneath the wearer's arm. The pack retains its shape as it is shifted so the pack and its contents are not vertically compressed.

The system is provided with one or two shoulder straps that are attached to the top of the pack near the upper end and at the lower ends to the side of the pack above the waistband at an adjustable connector, such as a tension buckle. The system may be worn with a single shoulder strap or with a pair of shoulder straps that criss-cross the front of the wearer's body. A slack adjuster is provided which is a removable short strap extending between a selected location on the shoulder strap and the belt.

Thus, the pack system of the present invention can be configured and adjusted to fit the physical configuration of the wearer and accommodate various size, weight, shape and density loads. The system can be adjusted for comfort and, once adjusted, it remains in that position so the wearer does not have to repeatedly readjust the harness or attachment system.

In use, the wearer can easily access the contents of the pack which can be switched or rotated from the normal carrying position at the back of the wearer to an access position in front of the wearer by simply disengaging the slack adjuster and loosening the waist belt and sliding the pack and belt forwardly. In reverse, once the wearer has accessed the pack, the pack may be rotated to the carry position and secured by tightening the belt. The compression system does not require readjustment. Once in the carry position, the waist belt is tightened and the slack adjuster is reattached to the shoulder strap.

BRIEF DESCRIPTION OF THE DRAWINGS

The above objects and advantages of the present will become more apparent from the following description, claims and drawings in which:

DETAILED DESCRIPTION OF THE DRAWINGS

Figure 1:
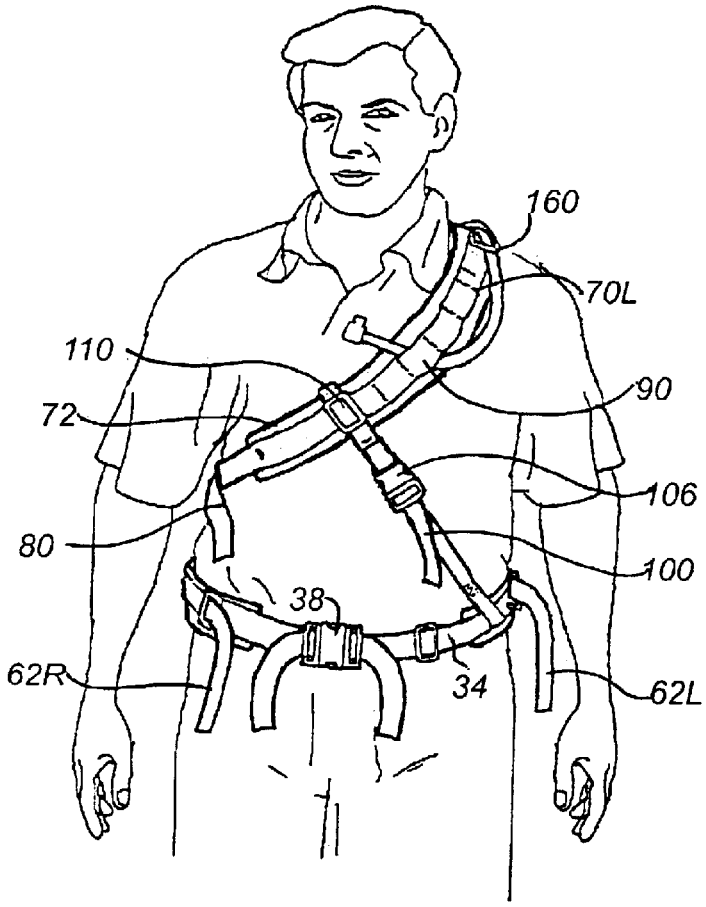
FIG. 1 is a front view illustrating a person wearing a pack according to the present invention showing a pack having a single shoulder strap and in the carry position.

Turning now to the drawings, particularly FIGS. 1 to 6, the pack system of the present invention is generally designated by the numeral 10. The pack system 10 includes a pack 12 which is shown as a bag having a rear surface 14, front surface 16 and top 18 and bottom 20. "Front" refers to the surface disposed adjacent the back of the wearer. The bag is provided with one or more interior and exterior pockets and has a zipper or other closure to provide access to the interior of the bag.

Figure 6:
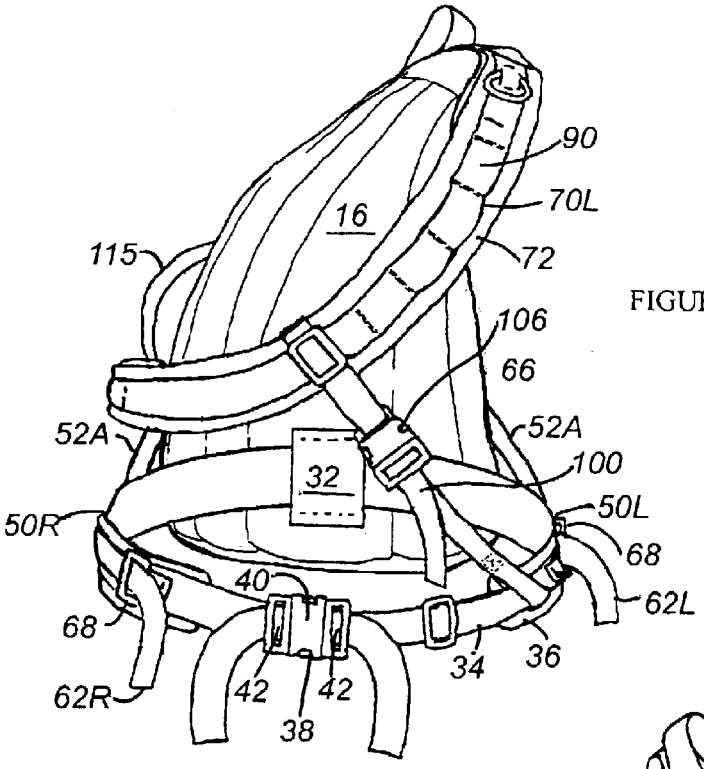
FIG. 6 is a rear view of the pack of FIG. 5.

The pack can be made of any suitable material such as canvas, nylon or other fabric or may be a hard shell of plastic or aluminum. The term "pack" also comprehends a panel or frame for attachment of an item. Preferably, the front surface 16 of the pack is provided with padding for the comfort of the wearer. Again, as emphasized, the bag may be of any particular shape or configuration as shown. The pack 12, shown for purposes of illustration, is more or less conventional and is representative of the style used as a backpack for hikers or as a bag for containing books and school supplies as normally carried by students. The pack may also simply be a flat panel of semi-rigid material on which specialized equipment can be attached. The pack may also be configured and padded to contain electronic equipment such as laptop computers and the like, or even configured as a carrier for small infants having a pouch and opening through which the infant's legs depends. FIG. 6 illustrates one preferred form of pack 12 having access bays 12A, 12B and 12C with zipper closures 15A, 15B and 15C and extending downwardly for convenient access to stowed items when the pack is shifted to a frontal position.

The front surface 16 of the pack, which is the surface adjacent the back of the wearer in the normal position, carries one or more waist belt 34 connector locations shown as loops 30, 32 near the bottom edge 20. The loops are a nylon or fabric material and are stitched or otherwise secured to the pack surface 16 and are of a width to slidably accept the waist belt 34. The connectors allow the pack to tilt or pivot as it is shifted. The belt may also be attached to the pack by pivotal fasteners or may even by stitched.

Waist belt 34 encircles the torso of the wearer preferably just above or at the upper pelvic area extending to the front and lower abdominal area. The belt 34 is of a fabric material such as nylon and preferably includes a padding 36 for the comfort of the wearer. The waist-encircling belt has fastener 38 with components 40, 42 at the opposite free ends of the belt. One fastener component 40 is a female receptacle and the other component 42 is a male fastener component of the type generally known as bayonet side-squeeze tension fasteners. The female component is stitched to one end of the belt by a fabric loop 45. The male component has a tension slot 46 on it and is attached by a strip of flexible webbing material 48 to the other free end of the belt so as to be adjustable. Thus it will be seen that the fastener 38 can be conveniently adjusted to a comfortable position snugly extending around the wearer when the components 40, 42 are engaged or released increasing the slack in the belt without unbuckling the components.

An important provision of the present invention is the compression-suspension system which serves as a tightener to tighten the pack to a comfortable, snug position regardless of the size, weight, shape or density of the load. This system is best seen in FIGS. 3, 4, 7 and 7A. The compression suspension system consists of a pair of assemblies 50R, 50L at the opposite right and left sides of the pack. These systems 50R, 50L are essentially the same and the description of one, 50R, is believed sufficient. The system consists of a first flexible strap 52 which is attached at the outer surface 14 at the rear of the pack either by stitching or by attachment to an adjustable buckle 54 secured at this point. The strap extends around the side of the pack through one or more guide loops 56 secured to the side of the bag having a section 52A and a section 52B. The strap extends through the loop 60B of an adjustable tension buckle 60 and returns and is secured to the side of the pack at 66 where it is stitched at a mid-location on the side or rear of the pack. The adjustable buckle 60 is secured to an adjustment strap 62R or 62L. The adjustment strap 62R, 62L is stitched or otherwise secured to the belt 34 at a location 63 inward of the free end of the belt and extends rearwardly through the loop 60B of the adjusting buckle. The strap 62R, 62L returns through a guide loop 68 so that its end is normally disposed adjacent the belt fastener 38 in a convenient position. The tensioning force applied to the strap 62R will be transferred to sections 52A and 52B to compress the load. The force may be transferred equally to the sections or unequally if load compression requires more force be applied to one section. Thus it will be seen that the wearer may, by applying a forward pulling force on the free end of the strap 62R, can bring the lower end of the pack 12 into a comfortable, snug position against the wearer's back. The system consisting of the straps described above is generally referred to as an optimizing compression-suspension system which serves to compress or snug the pack against the wearer and the contents within the pack to prevent movement as the wearer walks or runs.

It will be seen that the compression-suspension system, in effect, has a Y-shaped yoke formed by the strap 52 which extends from the rear of the pack through the buckle 60 and then to a point of attachment 66 on the side of the pack. The strap 52 attaches at at least two spaced-apart points to the pack. The adjusting strap 62R completes the yoke. Exerting a forward pull on tension strap 62 will "compress" the pack via the yoke. Once adjusted, the pack remains in this position due to friction at loop 60A until released by pulling forward on the side strap to operate the system pulling together the two ends of the compression straps.

As pointed out above, a similar system 50L is secured to the opposite side of the pack terminating at a second adjustment strap 62L at the opposite free end of the waist-encircling belt. Each system can be independently adjusted to the preference and comfort of the user and in accordance with the load and contents of the pack.

Figure 2:
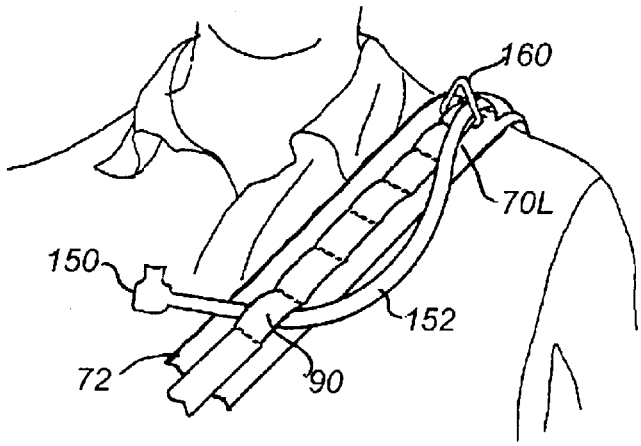
FIG. 2 is a detail view of a portion of the upper portion of a shoulder strap with a hydration attachment.
Figure 3:
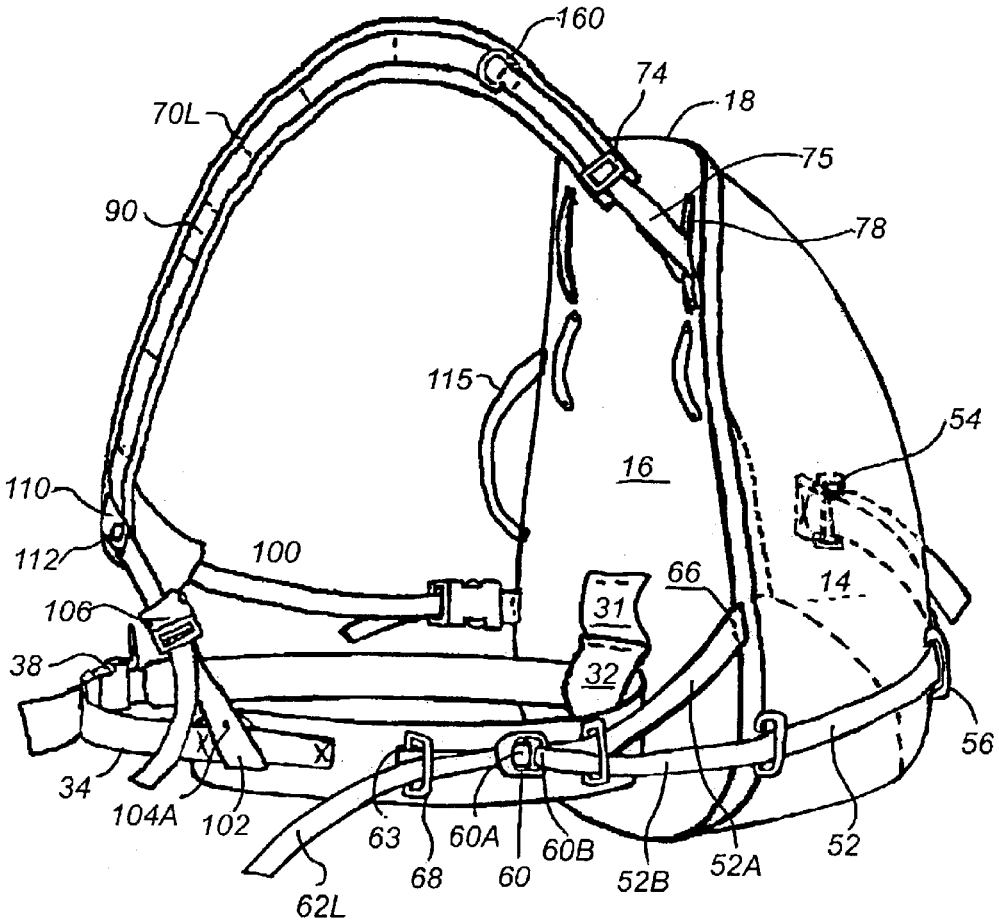
FIG. 3 is a side view of the pack of the present invention.
Figure 5:
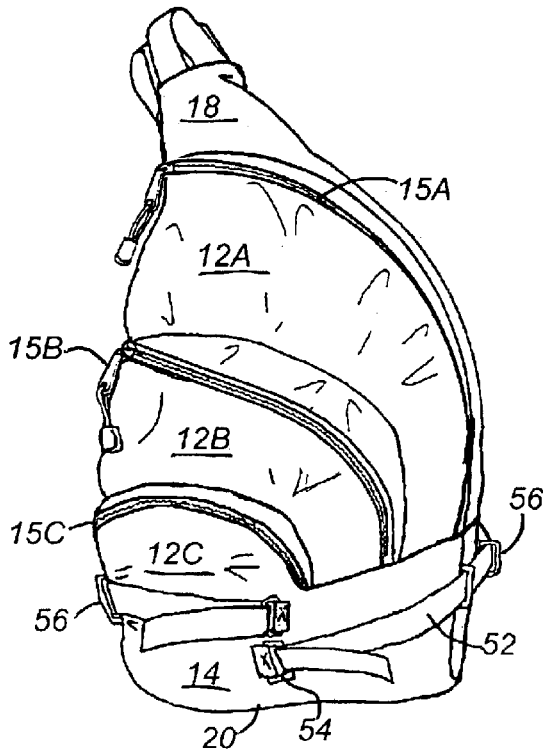
FIG. 5 is a view similar to FIG. 4 showing the pack with a single shoulder strap.
Figure 7:
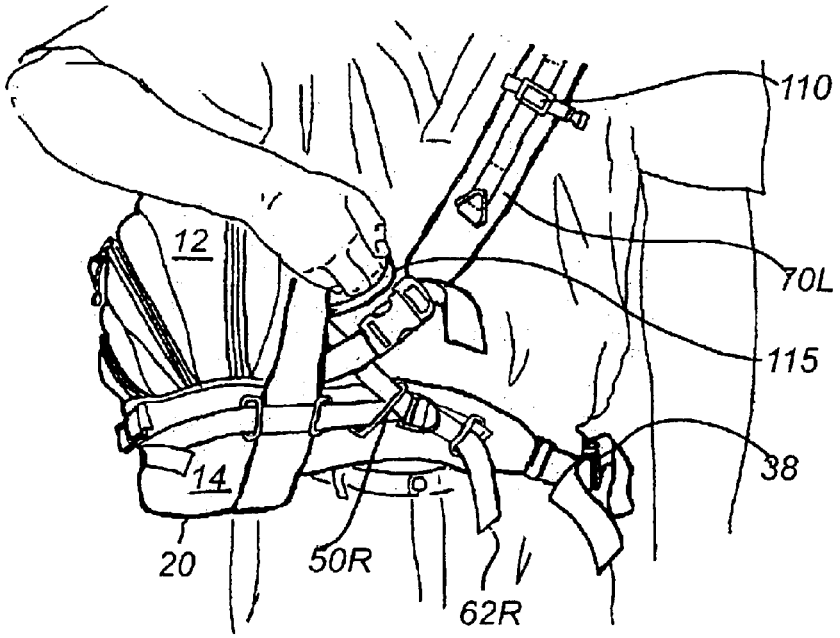
FIGS. 7 and 7A are detail views of the waist belt and compression system.
Figure 8:
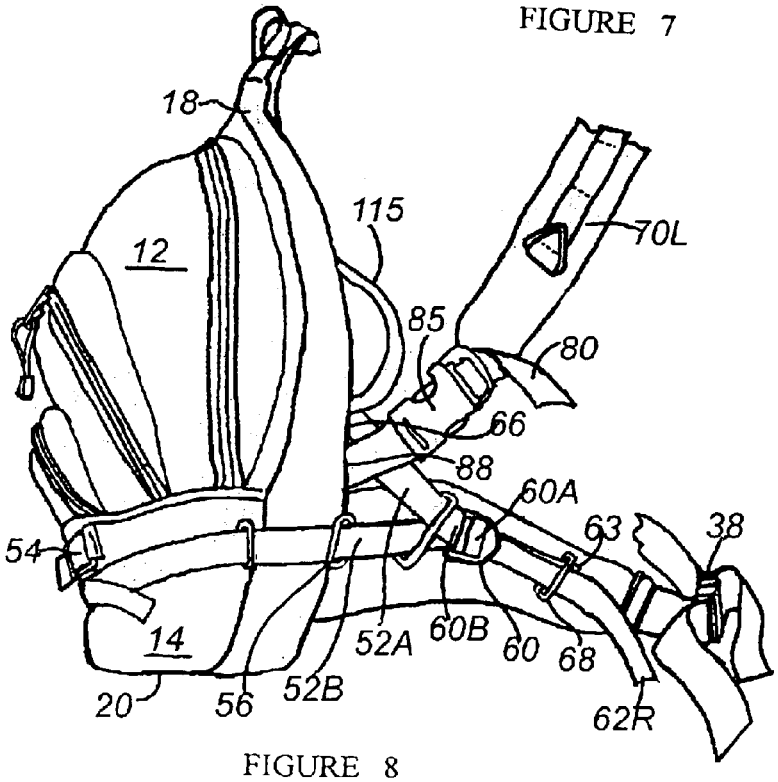
FIGS. 8 to 11 illustrate the sequence of operations involved in shifting the pack from a rear to a frontal position.
Figure 7A:
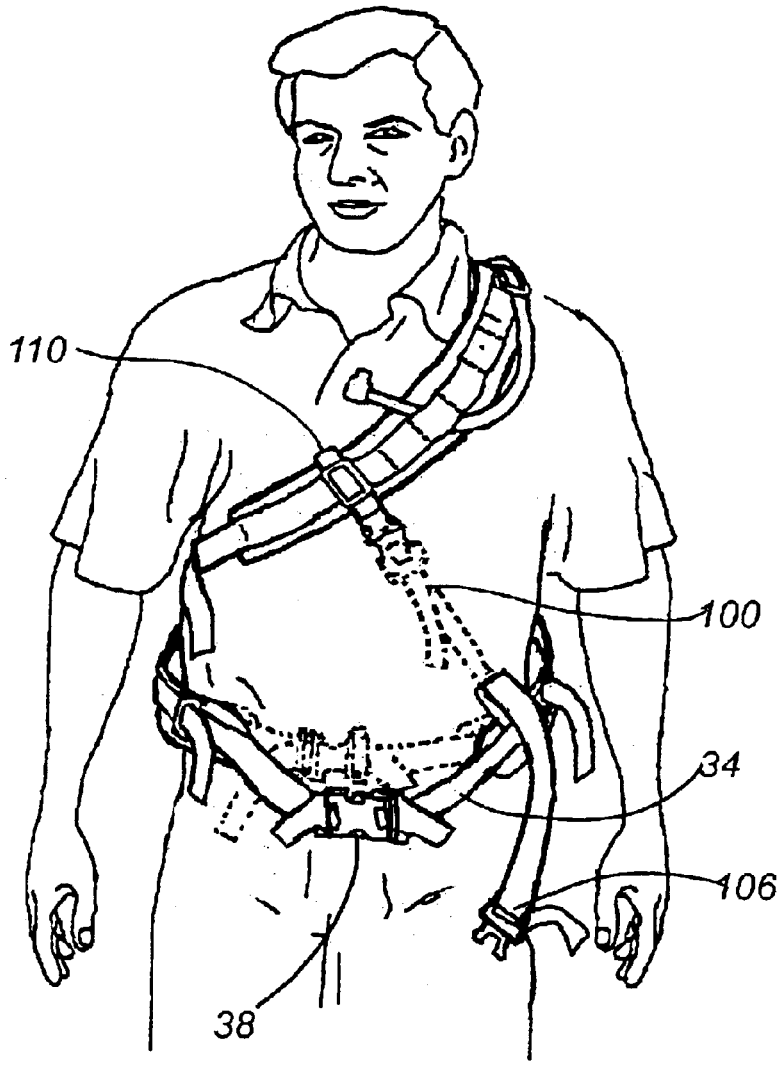

As seen in FIGS. 1, 2 and 5, at least one shoulder strap assembly 70L is provided to support at least a portion of the weight of the pack from the shoulder of the wearer. The shoulder strap assembly 70L consists of a padded section 72 of fabric such as nylon, or other material, having a length sufficient to extend generally from the shoulder across the body to the waist of the wearer. The upper end of the padded section carries an adjusting loop at 74 (FIG. 3). A flexible strap 75 extends from the end of the padded strap through fabric loop 78 on the pack and returns to the adjusting loop 74 so that the position of the strap relative to the pack may be adjusted. This allows the strap 70L to be raised, lowered and tightened across the chest of the wearer. The lower end of the padded strap also carries a flexible attachment strap 80 which extends to one component 82 of a two-component fastener 85 such as a side squeeze fastener. The strap extends through the loop of the male portion 82 of the fastener. The female portion 84 of the fastener is secured by a flexible strap 86 to the lower edge of the side of the pack at 88. Thus, the shoulder strap can be easily secured in place or detached simply by unfastening the fastener by applying a force to the unlocking members of the fastener 85. The relative position of the lower end of the strap to the fastener can be adjusted by sliding the lower fastener strap 86 relative to the male portion of the buckle.

The strap 70L carries a number of loops 90 at spaced locations along its length for selective securement of a slack adjuster as will be explained. If the user selects a pack with a single strap, it can extend either over the right or left shoulder depending on the preference of the wearer.

In use, the wearer will first position the waist belt 34 relative to the backpack. This accomplished by inserting the belt 34 into a selected one of the loops 30, 32 at the lower side of the inner surface of the pack. The position selected will depend upon the size of the bag and the physique of the wearer. A shoulder strap, such as 70L, is attached in a cross-over position extending from the upper edge of the pack to the opposite lower side of the pack. The wearer will then place an arm through the area between the shoulder strap and the bag and then adjust the shoulder strap 70L to the desired length. The opposite ends of the waist encircling belt 34 can then be grasped and placed around the wearer. The buckle components are engaged and the belt adjusted to the desired fit. Again, the belt should be positioned so that it extends across the upper pelvic area with the buckle being positioned in the lower abdominal area of the wearer. The wearer will next snug the pack using the compression systems by exerting a forward pull on the two free ends of the compression adjusting straps 62R, 62L at the front of the bag. This will "pull" the pack against the back of the wearer stabilizing the pack and its contents.

The wearer may now engage the slack adjuster 100 which extends from the shoulder strap 70L to either the waist-encircling belt or one of the straps of the compression system. The slack adjuster has a loop 102 at its lower end which, as shown, is looped about the waist belt and secured at a snap 104A. Adjusting buckle 106 is located at an intermediate location along the strap. The upper end of the slack adjuster is attached to the shoulder strap by means of loop 110 which terminates at a snap 112. It is noted that the slack adjuster may be positioned in any one of a number of loop locations 90 along the length of the shoulder strap. Preferably these locations are separated by stitching as shown, but may also be D-rings or similar fasteners. The wearer may select a location which best achieves the desired comfort and fit desired by the wearer.

Figure 4:
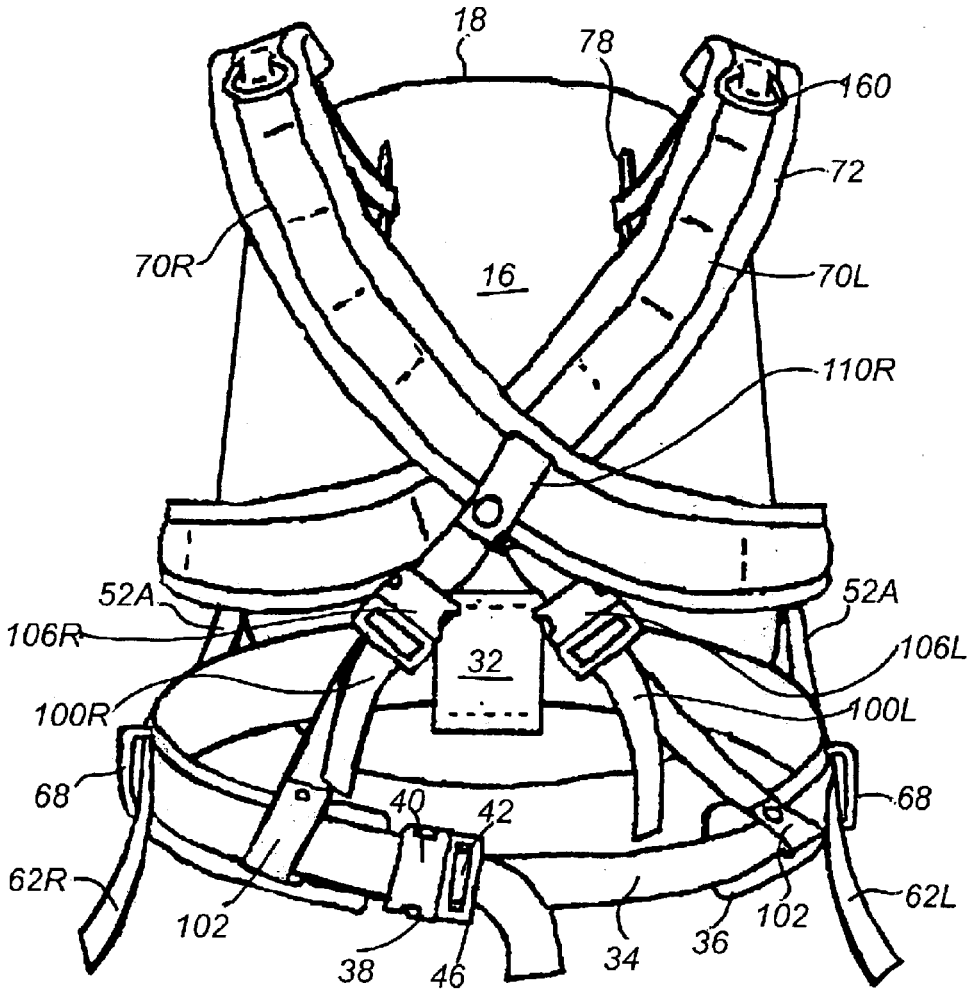
FIG. 4 is a front view similar to FIG. 2 showing a pack according to the invention with a pair of shoulder cross-over straps.

FIG. 4 shows the pack incorporating two shoulder straps positioned in cross-over fashion. The second strap 70R is essentially the same as described above with reference to previous figures. The strap 70R extends from the upper edge of the bag across by the wearer and is secured at its lower end at a disengageable fastener. A second slack adjuster system 100R is also shown in connection with strap 70R so that the second shoulder strap can be adjusted to the desired fit. It will be apparent that either shoulder strap 70R, 70L, or both, may be utilized depending on the pack size, load and physical characteristics and preferences of the wearer. A second compression-suspension system is shown at the lower right side of the pack as has been described.

In use, with the shoulder straps, slack adjuster and compression-suspension system, the pack may be adjusted to fit almost any torso configuration and load configuration. The wide range of adjustments provide comfort when the wearer is wearing the pack and is engaged in normal activity such as walking or hiking.

Figure 9:
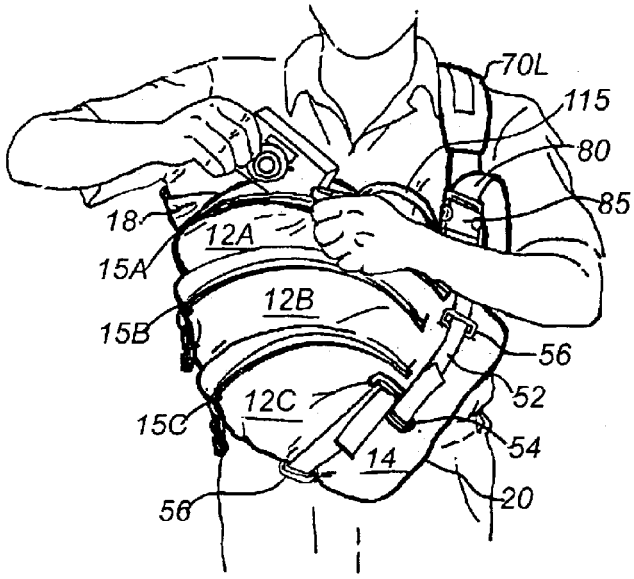
Figure 10:
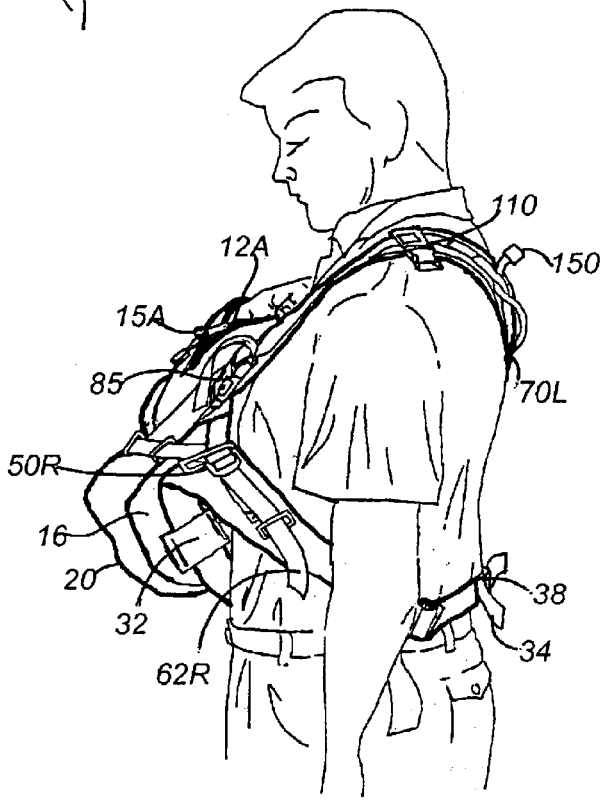
Figure 11:
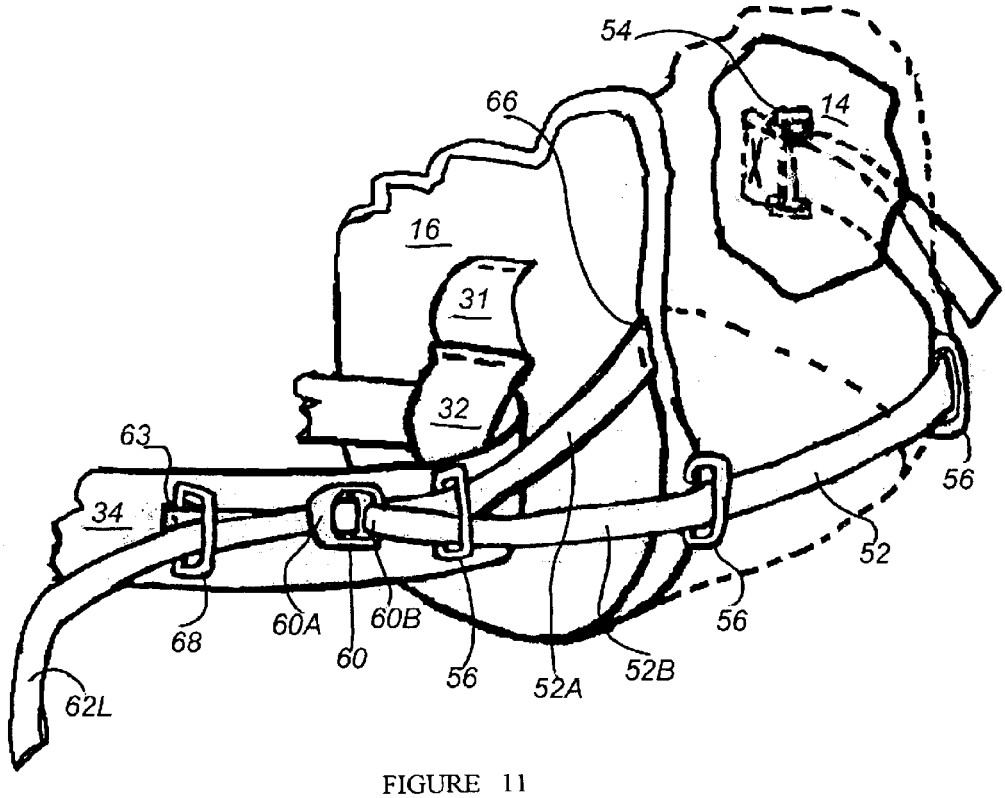

If the wearer wishes to access the contents of the bag, the wearer will simply unfasten or loosen the buckle on the waist belt. The sequence of operations involved in shifting the pack are seen in FIGS. 7 to 10. If both shoulder straps 70R, 70L are being utilized, as shown in FIG. 4, it will be necessary to disengage one of the shoulder straps. In order to then move the pack from the front to the back of the wearer, the wearer can simply reach around and grasp the side of the bag at pull handle 115 or grasp the lower belt portion and rotate the pack in either a counter-clockwise or clockwise position. This will allow the pack to be slid from the back of the wearer around the side of the wearer to a position either at the side or the front of the body of the wearer so the wearer can access the bag. The independent compression suspension system maintains integrity and still allows the pack to be moved around the side of the wearer and allow it to tilt as seen in FIG. 9 for better access to the storage bays or compartments. As the pack is shifted around the body, it will slide on the belt and swivel as necessary to conform to the body of the wearer. In fact, once the bag is positioned in the front of the wearer, the waistband can be re-engaged and the bag can be worn in the front position, as well as the back position. FIGS. 9 and 10 show the pack in a frontal position.

The advantage of the present system as compared to prior art, including my prior patent '403, is that the bag can easily be shifted from the normal position at the back of the wearer to the frontal position beneath the arm without compressing or rearranging the bag. This is particularly important if the bag contains items which are not compressible such as a laptop computer or books. Thus, the present invention facilitates easy, convenient transition from the rear position to the front access position regardless of the contents or items contained within the pack. FIG. 9 shows the convenience of access, particularly with the pack configured, as seen in FIG. 6, having access to bays 12A, 12B and 12C. The shifting operation can be performed in either a standing or sitting position.

ACCESS: A significant benefit is the ability of the user to access the contents of the pack without removing the pack from his or her body. This task is also accomplished without disturbing the pack configuration and load compression. To do this, the user will unsnap the slack adjusters 100 in front; loosen the waist belt buckle 38 about 3 inches in circumference (do not unbuckle the belt), grasp the pack and just slide the pack to the "access" position. Once the waist belt is tightened, the optimizing compression suspension remains intact and when the slack adjuster is re-buckled, it remains in its original tension position. The sequence is reversed to place the pack in the carry position. When the pack is slid around the user's body, the shoulder strap also rotates around the torso of the user diagonally moving with the rotation of the pack to the front from the back. The diagonal closures are in a generally horizontal, convenient access position as seen in seen in FIG. 9.

Various accessory features can also be utilized with the pack. FIGS. 1 and 2 show a hydration system 150 having a supply tube 152 terminating at a mouthpiece. The tube 152 extends through a loop 160 and loop 90 terminating at the mouthpiece convenient to the user and maintained out of the way. A conventional bladder, not shown, may be stored in the pack.

The following is a brief summary of the features and advantages attendant to the pack system of the invention:

Features:

Slack adjuster system for maximum stabilization and comfort

Tethered waist belt for comfort and switching

Optimizing compression suspension system for load lock-down

Quick switch system for easy shifting of the pack

Pack access system with ergonomically designed zipper bays

Hydration tube conduit and lashing

One-handed operation to access load

One time adjustment

Comfortable harness system hugs and snugs the body

Terms and Definitions:

1. SLACK ADJUSTER SYSTEM: A strap that attaches to the waist belt at one end and the shoulder strap at the other end. Its purpose is to secure and conform the shoulder strap to the torso. The slack adjuster is also able to be positioned at multiple locations along the shoulder strap for a more comfortable and customized fit.
2. TETHERED WAIST BELT: In order for the pack to be able to transform and articulate, move around the body from the carry, lock-down position on the back to the access position, the independent compression suspension system is provided. The waist belt works independently of the pack or its contents and allows the pack and its contents to move freely around the user's body independent of the circumference and shape of the waist cross-section providing the user with a sliding action that automatically compensates for the load. This is done because the waist belt maintains its circumference during the entire sliding motion, and the pack maintains its shape. The slack in the waist belt allows the pack to slide around the wearer's body with one shoulder strap in place without impediment. The optimizing compression system "tethers" the bag to the waist belt at the outer sides of the bag. This configuration allows the bag and waist belt to maintain their shape and function while moving around the torso independent of one another. The system also allows the bag to tilt while being switched from front to back, placing the zipper bays in a maximized and desirable position on the front of the user and also allows the pack to move freely about the torso following its intended course.
3. OPTIMIZING COMPRESSION STRAP SYSTEM: For automatic load lock-down and stabilization, the compression-suspension strap system is attached to the waist belt at two locations and to the pack at or near the outer ends near the bottom of the bag. Its purpose as part of the tether waist belt system is to stabilize the outer sides of the pack bag in relationship to the waist belt by activating it by pulling on the activation strap. The compression system has two distinct purposes: It pulls the pack bag towards the waist belt maintaining constant tension at the sides of the bag and the compression strap system will optimize and automatically regulate the amount of pressure it puts on the contents of the bag.

4. QUICK SWITCH SYSTEM FOR EASY RELEASE: There are two distinct modes of use for the pack. One is the carry or "lock" position on the back of the user. The other is the "access" position in front of the user. When the user initially dons the pack, the pack is fitted and adjusted using the pack's multiple strap configuration. When the pack is in the "carry" position, the waist belt is fully tightened to a comfortable level around the user's waist. The shoulder strap(s) extend across the torso of the user and is adjusted to the user's particular body size and shape. The slack adjuster is engaged and the slack is taken out of the shoulder strap(s). Lastly, the user will pull forward on the actuation straps on the side of the waist belt to engage the tether compression suspension load optimization system. The pack is fully engaged and secured and the wearer is ready for most any strenuous activity.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A pack system worn by a wearer comprising:

(a) a pack having a front surface, rear surface, top, bottom and opposite first and second sides;

(b) a waist belt having first and second free ends, said waist belt attached to the front surface of said pack and having cooperative adjustable fasteners associated with said first and second belt free ends so the belt may be selectively tightened or loosened about the torso of the wearer;

(c) a first compression suspension system including:

(i) a first compression strap member having opposite ends secured to said first side of said pack at spaced-apart locations;

(ii) an adjuster having a free end and connected to said first compression strap member at a connector; and (iii) retaining means for retaining said first compression strap member in a selected position when a manual tensioning force is applied via said adjuster; and (d) a first shoulder strap extending between the top of said pack and one of said sides to extend across the chest area of the wearer whereby said waist belt can be loosened to allow the wearer to shift the pack from a rear to a frontal position and vice versa.

2. The pack system of claim 1 further including a slack adjuster extending between said shoulder strap and said waist belt.

3. The pack system of claim 1 further including a second shoulder strap extending between the top of said pack and the other of said sides across the chest area of the wearer.

4. The pack system of claim 1 wherein said pack is selected from the group consisting of flexible bags, semi-rigid containers or rigid containers.

5. The pack system of claim 1 wherein said waist belt is flexible and said cooperative fastener comprise squeezable fastener components.

6. The pack system of claim 2 wherein said slack adjuster is removably attached to the waist belt and shoulder strap.

7. The pack system of claim 2 wherein said shoulder strap is provided with multiple attachment locations for the slack adjuster.

8. The pack system of claim 1 wherein said waist belt is attached to said pack at a loop through which the belt passes.

9. The pack system of claim 1 wherein said connector between said compression strap and said adjuster is slidable.

10. The pack system of claim 1 wherein said first compression strap member and adjuster form a Y-shaped yoke.

11. The pack system of claim 1 wherein said pack has multiple bays on the rear surface with closures extending downwardly across the pack.

12. The pack system of claim 11 wherein said closures comprise zippers.

13. The pack system of claim 1 including a second compression-suspension system including:

(i) a second compression strap member having opposite ends secured to said second side of said pack at spaced-apart locations;

(ii) an adjuster having a free end and connected to said second compression strap member at a connector; and (iii) retaining means for retaining said second compression strap member in a selected position when a manual tensioning force is applied via said adjuster.

14. A compression-suspension system for a pack having opposite sides and a waist belt extending about the torso of a wearer, said system comprising:

(a) a compression strap member having opposite ends secured to a side of said pack at spaced-apart locations;

(b) an adjuster connected to said compression strap member at a connector; and (c) retaining means for retaining said compression strap member in a selected position when a manual tensioning force is applied to said compression strap via said adjuster.

15. The system of claim 14 wherein said slack adjuster is attached to the said belt and said connector is slidable.

16. The system of claim 14 wherein said compression strap and said adjuster form a generally Y-shaped yoke.

* * * * *